US007100639B2

(12) United States Patent
Rüb

(10) Patent No.: US 7,100,639 B2
(45) Date of Patent: Sep. 5, 2006

(54) CONTROL VALVE

(75) Inventor: Winfried Rüb, Waldshut-Tiengen (DE)

(73) Assignee: Bucher Hydraulics GmbH, Klettgau (DE)

( * ) Notice: Subject to any disclaimer, the term of this patent is extended or adjusted under 35 U.S.C. 154(b) by 0 days.

(21) Appl. No.: 10/472,419

(22) PCT Filed: Mar. 4, 2002

(86) PCT No.: PCT/IB02/00661

§ 371 (c)(1),
(2), (4) Date: Sep. 19, 2003

(87) PCT Pub. No.: WO02/075162

PCT Pub. Date: Sep. 26, 2002

(65) Prior Publication Data

US 2004/0079425 A1 Apr. 29, 2004

(30) Foreign Application Priority Data

Mar. 21, 2001 (CH) ..... 0522/01

(51) Int. Cl.
*F15B 13/043* (2006.01)
*F15B 13/044* (2006.01)

(52) U.S. Cl. ..... 137/625.64; 137/269; 137/596.16; 137/596.17; 137/625.65

(58) Field of Classification Search ..... 137/269, 137/596.16, 596.17, 625.64, 625.65
See application file for complete search history.

(56) References Cited

U.S. PATENT DOCUMENTS 3,225,003 A 12/1965 Macon
4,245,671 A 1/1981 Kosugui
4,860,792 A * 8/1989 Ichihashi et al. ..... 137/596.17
4,924,902 A * 5/1990 Lewis et al. ..... 137/596.16
5,785,087 A 7/1998 Takahashi et al.
6,192,928 B1 2/2001 Knoell et al.
6,196,247 B1 * 3/2001 Knoell et al. ..... 137/596.16

FOREIGN PATENT DOCUMENTS

DE 32 25 003 A1 7/1982

* cited by examiner

*Primary Examiner*—Gerald A. Michalsky
(74) *Attorney, Agent, or Firm*—Cohen, Pontani, Lieberman & Pavane

(57) ABSTRACT

The invention relates to a control valve (10) for controlling the pressure and flow of hydraulic oil from or to the working connections (A, B) of a consumer. The pressure and the pressure flow are controlled by means of at least one sliding piston which can be actuated by at least one drive mechanism and which can be displaced in a slider hole and in co-operating annular channels. The invention is characterized in that the annular channels are symmetrically arranged, whereby a tank connection annular channel is arranged in the symmetrical centre point on a symmetrical axis. Annular channels associated with the working connections (A, B), pump-pressure annular channels, load-sensing annular channels and end-chamber annular channels are arranged behind each other on both sides. According to the invention, the latter can be connected to other channels. The aim of the invention is to create equivalent hydraulic ratios for both working connections A and B and to keep the number of control edges in the control valve to a minimum.

8 Claims, 9 Drawing Sheets

CONTROL VALVE

PRIORITY CLAIM

This is a U.S. national stage of application No. PCT/IB02/00661, filed on 4 Mar. 2002. Priority is claimed on that application and on the following application: Country: Switzerland, Application No.: 0522/01, filed: 21 Mar. 2001.

BACKGROUND OF THE INVENTION

1. Field of the Invention

The invention relates to a directional valve for controlling the pressure and flow of hydraulic oil to an from working connections of a consumer, wherein the pressure and flow can be controlled by a slide piston which is actuable by a drive and displaceable in a slide bore and by annular ducts connected to the piston.

2. Description of the Related Art

Such directional valves are suitable, for example, for the activation of hydraulic drives which move implements or tools on working appliances, such as harvesting machines and loaders. The hydraulic drives may in this case be, for example, single-acting plunger cylinders, double-acting synchronous or differential cylinders or oil motors for one or two directions of rotation. Directional valves for such applications are known in large numbers and in the most diverse possible versions.

A directional valve of this type is known from DE 32 25 003. The pressure medium quantity is controlled by means of clocked switching magnets in proportion to an analog input signal. In this directional valve, there are no load recording lines. The usefulness of such a directional valve is therefore greatly restricted. In one of the exemplary embodiments, three of the annular ducts of the directional valve are connected to the tank. This solution is therefore not particularly advantageous because, with a view to the dynamic behavior of the direction valve and also to the manufacturing costs, the aim must be to keep the number of annular ducts as low as possible.

A directional valve is also known from DE-A1-196 46 445 which shows a valve arrangement containing two directional valves. Each of these directional valves serves for activating a double-acting consumer. Each of the directional valves is assigned a pressure balance in each case. The common pressure balance is placed in the valve slide of each directional valve, said valve slide being designed as a hollow slide. As a result of the axial movement of the valve slide into one of the working positions A and B, this pressure balance can be assigned to one or other of the working connections A, B. Directional valves and lifting cylinders of such a type are used in mobile hydraulics, for example in agricultural appliances.

DE-A1-196 46 426 discloses an arrangement which contains two directional valves and which likewise contains the pressure balance in the valve slide designed as a hollow slide. In one of the directional valves, there is an additional control magnet, as a result of the activation of which the control piston of this directional valve is brought into a position in which the two working connections of the cylinder to be controlled are connected to one another, this being known as a floating position. It is specified, in this respect, that separate ducts for control lines and pilot valves are not necessary in order to achieve the floating position.

DE-A1-197 07 722 discloses an arrangement, by means of which the inflow and return to and from a double-acting consumer can be controlled independently of one another.

This is achieved by means of a continuously controllable directional valve for the inflow and continuously controllable throttle devices from the working connection A or B to the return. Here, too, the pressure balance is arranged in the valve slide of the directional valve.

Details of a valve, to be precise its stop valves, are known from DE-A1-199 19 014. The pistons of these stop valves bear with their end faces on one another, but these possess recesses forming a pressure space. When this pressure space is acted upon by a pressure of defined magnitude, the pistons can be moved axially apart from one another. The floating position for the valve is thereby assumed.

An arrangement with a directional valve which manages without a pressure balance is known from GB-A-2 298 291. The function of the latter is achieved by alternative means, to be precise by pressure sensors in the inflow and outflow of the hydraulic consumer, a pressure sensor for the pump pressure, travel sensors in each case on a valve slide acting independently for the working connection A or B, and an electronic control, using the signals from these sensors. This also shows that a plurality of identical valve units can be assembled to form a block controlling a plurality of consumers. In the event of the failure of sensor signals, a direct control of the volume flow or of the pressure in the working connection is no longer possible. Additional means are therefore necessary in order to compensate this disadvantage to an extent such that it is at least still possible to move the working appliance into a safe position.

The above description of the known prior art shows that there is a series of solutions for achieving a comprehensive functionality of such directional valves. The aim in this context is always to provide valves which are as simply constructed as possible and can be produced cost-effectively. The functionality and, particularly, the dynamic behavior are determined by the configuration of the valve slide and of the annular ducts and connecting lines cooperating with it. This also governs the number of control edges. In this case, the behavior is also decisively influenced by dimensional tolerances. It is also always necessary to take into account that the inflow metering and the return throttling for the hydraulic consumer are to be independent of one another.

SUMMARY OF THE INVENTION

The object on which the invention is based is to provide a directional valve which, along with a simple construction allowing cost-effective manufacture, has a dynamic behavior which is improved, as compared with the prior art. What is also achieved thereby is that the directional valve is suitable for different applications and by virtue of special refinements possesses a wide functional scope.

According to the invention, a directional valve for controlling the pressure and low of hydraulic oil to and from a consumer includes first and second working connections for connecting to said consumer; a slide bore having an axis of symmetry; a slide piston movable in the slide bore; and a plurality of annular ducts surrounding the slide bore and communicating with the slide bore. The annular ducts include an annular tank connection duct on the axis of symmetry, and symmetrically arranged pairs of ducts including first and second annular working ducts connected to respective first and second working connections; first and second annular pump pressure ducts outside of said working ducts and connected to each other by a pump pressure duct connection; first and second annular load sensing ducts outside of said pump pressure ducts and connected to each other by a load-sensing connecting line; and first and second annular end space ducts outside of said annular load sensing ducts and connectable to other annular ducts.

DETAILED DESCRIPTION OF THE PREFERRED EMBODIMENTS

Figure 1:
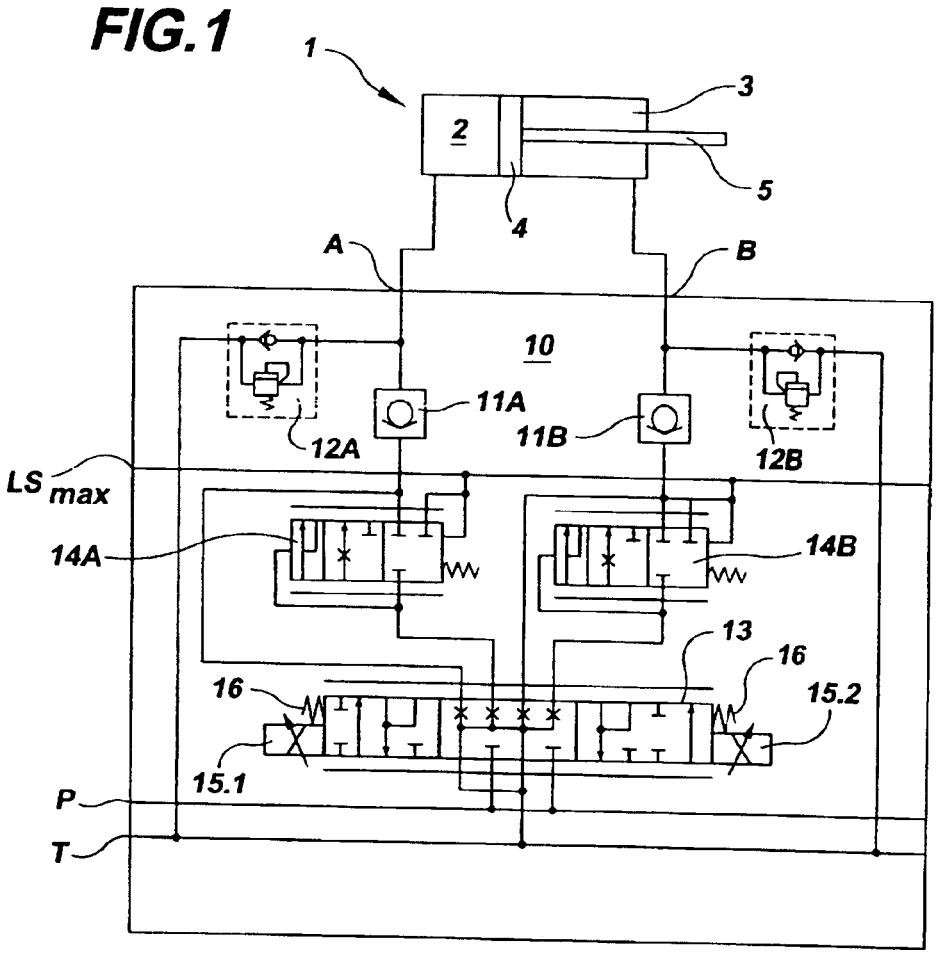
FIG. 1 shows a hydraulic diagram of a first embodiment.

In FIG. 1, a differential cylinder 1 has a first pressure space 2 and a second pressure space 3 which are separated from one another by a piston 4. Fastened to the piston 4 is a tappet 5 which transmits the movement of the piston 4 to an implement, not illustrated. The differential cylinder 1 is in this case only one possible example of use. Instead, for example, an oil motor may also be used.

The differential cylinder 4 is activated by a directional valve 10 which is designed according to the invention. In a known way, the directional valve 10 has working connections A and B, the first working connection A being connected to the first pressure space 2 and the second working connection B to the second pressure space 3 of the differential cylinder 1.

The directional valve 10 consists of a number of components and its construction is outlined below. A releasable nonreturn valve 11A lies at the working connection A and a releasable non-return valve 11B lies at the working connection B. Depending on the application, the releasable nonreturn valves 11A, 11B may even be dispensed with. Secondary pressure-limiting and feed valves 12A and 12B are arranged between a tank connection T and the respective working connections A and B. These secondary pressure-limiting and feed valves 12A, 12B act, for example, as suction follow-up valves. They are necessary, depending on the application, when external forces, the magnitude and direction of which may change, act on the tappet 5. They are mentioned here only for the sake of completeness, belong to the known prior art and are therefore unrelated to the implementation of the idea of the invention.

A slide piston 13 determines the functioning of the directional valve 10. This slide piston 13 is activatable, as will also be shown later. Pressure balances 14A and 14B are arranged between the slide piston 13 and the respective releasable nonreturn valves 11A and 11B or the working connections A and B. Since each of the working connections A and B is therefore assigned a separate pressure balance 14A and 14B, these are also designated as individual pressure balances. The pressure balances 14A and 14B therefore follow the slide piston 13 here. This is a principle often employed in the known prior art.

FIG. 1 shows, in addition, a pump connection P, from which the directional valve 10 is fed with hydraulic oil. An annular duct, described later, of the directional valve 10 is connected in a known way to the slide piston 13 by means of this pump connection P. Also shown is a load-sensing connection $LS_{max}$ which, with regard to valves of such a type, belongs to the prior art and therefore is not described any further here. The pump connection P, tank connection T and load-sensing connection $LS_{max}$ are present at the right and at the left margin of the diagram in FIG. 1, this being intended to express the fact that the directional valve 10 is constructed in such a way that a plurality of such directional valves 10 can be lined up to form a block, so that a plurality of consumers can be controlled. For the sake of clarity, the pressures are not depicted. A pressure $p_{LSmax}$ prevails at the load-sensing connection $LS_{max}$.

The slide piston 13 is axially displaceable by means of a drive. The drive is to be capable of displacing the slide piston 13 out of a neutral position corresponding to a position of rest in two directions. It is therefore state of the art to provide two such drives, to be precise a first drive 15.1, which presses the slide piston 13 to the right, and a second drive 15.2, which presses the slide piston 13 to the left. The drives 15.1, 15.2 are electrically controllable proportional magnets which act on the slide piston 13. In specific simple applications, the drives 15.1, 15.2 may also be switching magnets which have only the two positions "ON" and "OFF". In this case, they press the slide piston 13 in each case counter to a control spring 16. By way of one of the drives 15.1 or 15.2 being activated, therefore, the slide piston 13 is displaced out of its position of rest, on account of the control springs 16, the displacement of the slide piston 13 being proportional to the activation of the drives 15.1 and 15.2 when the drives 15.1 and 15.2 are proportional magnets.

The action of the pressure balances 14A, 14B is not discussed at this juncture because it is known from the known prior art. Pressure sensors or a differential-pressure sensor are likewise not depicted, which are present in any case and which are required in order to measure the pressure at the working connections A and B, this being a precondition for the movement of the piston 4 of the differential cylinder 1 to remain controllable in the event of changing directions of force.

Figure 2:
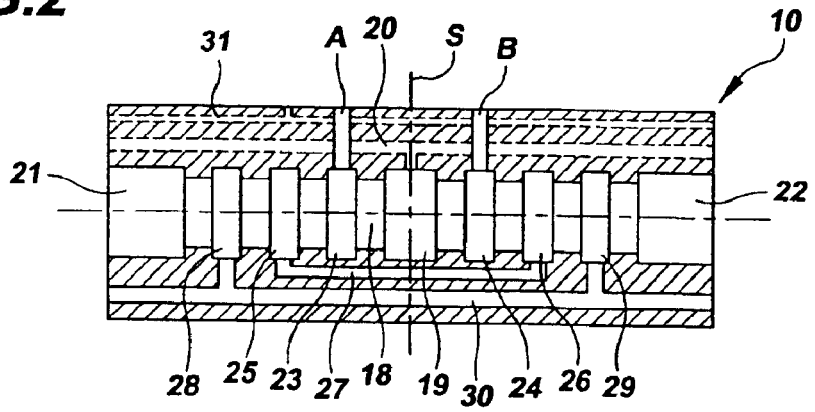
FIG. 2 shows a diagram of the arrangement of pressure ducts in the directional valve.

FIG. 2 shows a diagram of the arrangement of pressure ducts in the directional valve 10. This relates to that part of the directional valve 10 in which the slide piston 13 (FIG. 1), not illustrated here, is axially displaceable in a slide bore 18. This diagram shows the arrangement of pressure ducts, which according to the invention is symmetric to an axis of symmetry S, and their line-up likewise according to the invention. An annular tank-connection duct 19 is located in the middle, that is to say on the axis of symmetry, that is to say at the symmetry center point. Connected to this annular tank-connection duct 19 is a tank-connection duct connection 20 which leads to the two end faces of the housing of the directional valve 10. In the diagrammatic sectional drawing, the duct connection 20 is depicted by broken lines, because it lies in a different plane. It will also be shown that it is thereby possible, according to the invention, to connect the annular tank-connection duct 19 to other spaces by means of this tank-connection duct connection 20.

Annular spaces open toward the end faces are located at the two ends of the housing of the directional valve 10, to be precise, at one end, a first annular end-space duct 21 and, at the other end, a second annular end-space duct 22. It will also be shown that the tank-connection duct connection 20 can be connected to these two annular end-space ducts 21, 22, which likewise belongs to the essence of the invention.

The tank-connection duct connection 20 then consequently has the effect that the two annular end-space ducts 21, 22 have the same pressure, so that the same pressure acts on the end faces of the slide piston 13 (FIG. 1) axially displaceable in the slide bore 18. The slide piston 13 is thus pressure-relieved.

This tank-connection duct connection 20 does not necessarily have to be connected to other spaces. There are applications in which, for example, there is not to be this connection of the two annular end-space ducts 21, 22 to the annular tank-connection duct 19. There is therefore provision, according to the invention, for the two annular end-space ducts 21, 22 to be connectable to the annular tank-connection duct 19 by means of the tank-connection duct connection 20. This is dealt with again in more detail, as is the fact that there are or may be other connection possibilities. It will already be mentioned here, however, that, owing to the possibility that the annular tank-connection duct 19 may or may not be connected to the two annular end-space ducts 21, 22 by means of the tank-connection duct connection 20, the directional valve 10 is designed, according to the invention, in many different variants, thus making it possible, on the basis of a universal directional valve 10, to provide a multiplicity of variants for different applications. According to the invention, therefore, there is provision for the annular end-space ducts 21, 22 to be connectable to other annular ducts or other lines.

On both sides of the centrally arranged first annular tank-connection duct 19, annular ducts for the working connections A and B follow, to be precise an annular A-duct 23 on one side and an annular B-duct 24 on the other side. Located behind them on both sides, as seen from the middle, are annular pump-pressure ducts, on one side a first annular pump-pressure duct 25 and on the other side a second annular pump-pressure duct 26. These two annular pump-pressure ducts 25, 26 are connected to one another, according to the invention, by means of a pump-pressure duct connection 27 and are connected to the pump connection P (FIG. 1). The annular pump-pressure ducts 25, 26 are followed, as the next pair of annular ducts, by a first annular load-sensing duct 28 on one side and a second annular load-sensing duct 29 on the other side. Such annular load-sensing ducts are known per se, but are not present in the prior art according to DE-A1-32 25 003. The fact that, according to the invention, these annular load-sensing ducts 28, 29 are present broadens the possibilities of use of the directional valve according to the invention in a very significant way. According to the invention, the two annular load-sensing ducts 28, 29 are connected by means of a load-sensing connecting line 30. The load-sensing connecting line 30 is led, in the same way as the tank-connection duct connection 20, to the two end faces of the housing of the directional valve 10. This serves for the possible provision of further advantageous design alternatives for various uses of the directional valve 10, as is also described.

Moreover, a pilot-pressure connecting line 31 is also shown, which is generally present, but is used only for specific applications. The pilot-pressure connecting line 31 is led to the two end faces of the housing of the directional valve 10 in the same way as the tank-connection duct connection 20 and the load-sensing connecting line 30. This, too, serves for the provision of variants of the directional valve 10, to be precise those which are controlled by pilot pressure.

What is achieved by the arrangement according to the invention of the annular ducts 21, 28, 25, 23, 19, 24, 26, 29 and 22 in terms of symmetry and succession is, on the one hand, that equivalent hydraulic conditions prevail for both working connections A and B, and, on the other hand, that the number of control edges in the directional valve 10 is minimized. It is noteworthy that the directional valve 10 according to the invention, like that according to one of the exemplary embodiments of DE-A1-32 25 003, has seven annular ducts 21, 28, 25, 23, 19, 24, 26, 29, but at the same time, as mentioned, contains the annular load-sensing ducts 28, 29 which are absent in DE-A1-32 25 003. This was achieved, according to the invention, in that, according to the invention, the single annular tank-connection duct 19 lies on the axis of symmetry S and further annular tank-connection ducts are dispensed with. What is meant by "equivalent hydraulic conditions", in this context, is that the static and dynamic forces on the slide piston 13 which occur due to the flow of hydraulic oil from and to the differential cylinder 1 (FIG. 1) are very similar in the two symmetric regions of the directional valve 10 and constitute virtually no disturbance variables which would make the flow regulation from and to the working connections A, B unsymmetrical.

The symmetry and arrangement according to the invention of the annular ducts 21, 28, 25, 23, 19, 24, 26, 29 and 22 has the appreciable benefit that the directional valve 10 can be used for very different applications, for example different hydraulic drives, such as, for example, single-acting plunger cylinders, double-acting synchronous or differential cylinders or oil motors. As a result, the directional valve 10 can be equipped differently with a view to different applications, as will also be shown.

Figure 3:
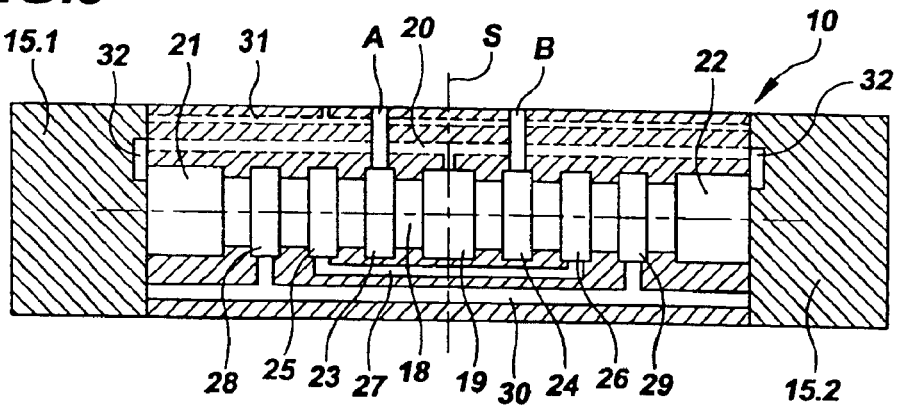
FIGS. 3 and 4 show this diagram with variants of connections.

FIG. 3 shows the same diagram, but in this case with drives 15.1 and 15.2 mounted on both sides on the end faces of the housing of the directional valve 10. In this case, in each of the two drives 15.1 and 15.2, there is a clearance 32 which serves, in the drive 15.1, to connect the annular tank-connection duct 19 to the first annular end-space duct 21 via the tank-connection duct connection 20 and, in the drive 15.2, correspondingly to connect the annular tank-connection duct 19 to the second annular end-space duct 22 via the tank-connection duct connection 20. It has already been mentioned that the intention of this is to operate, in a hydraulically pressure-relieved manner, the slide piston 13 (FIG. 1) which is axially movable in the slide bore 18.

The branches of the load-sensing connecting line 30 and the pilot-pressure connecting line 31 terminate, blind, at the drives 15.1 and 15.2, because they are closed off by the housings of the drives 15.1 and 15.2.

Figure 4:
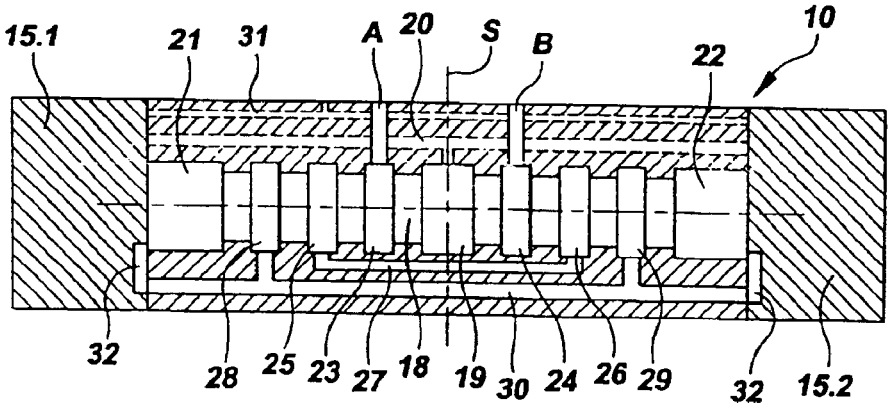

A variant is shown in FIG. 4. Here, in the drives 15.1 and 15.2, there are likewise clearances 32, but these are placed differently, so that they perform a different function. In this design variant, the clearances 32 make a different connection, to be precise, in the drive 15.1, the connection between the first annular end-space duct 21 and the load-sensing connecting line 30 and, in the drive 15.2, the connection between the second annular end-space duct 22 and the load-sensing connecting line 30. In this connection, too, the same pressure prevails on the two end faces of the slide piston 13, so that the latter is therefore pressure-relieved.

In order to achieve the condition of pressure relief for the slide piston 13, it is likewise possible that the annular end-space ducts 21, 22 are connectable to the annular pump-pressure ducts 25 or 26, this being by means of the pump-pressure duct connection 27, and this not being depicted in FIGS. 2 to 4 for the sake of clarity.

So that the various possibilities of the advantageous connection of the annular end-space ducts 21, 22 to other annular ducts or other lines can be implemented in a simple way, all these connecting lines are also led onto the end faces of the housing of the directional valve 10. By means of the drives 15.1, 15.2 and the position of the clearance 32, it is then determined which connection is actually implemented. Without any modifications having to be carried out on the housing of the directional valve 10, various advantageous embodiments are thus possible.

However, since there may also be the wish to use standardized drives 15.1, 15.2, it is also possible, within the scope of the invention, to implement the respectively desired connections between the annular end-space ducts 21, 22 and other annular ducts or other lines by means of connections within the housing of the directional valve 10, for example by means of corresponding bores.

Figure 5:
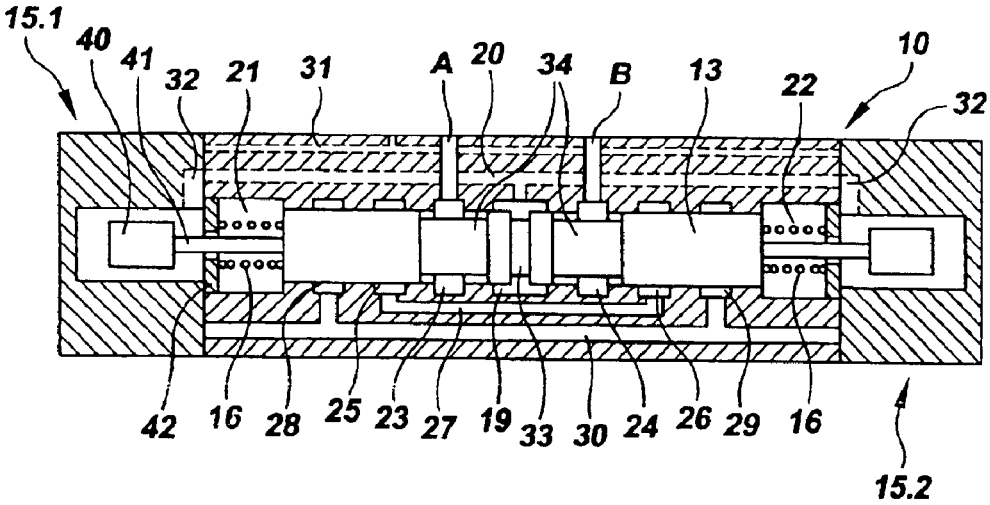
FIG. 5 shows this diagram with an inserted slide piston and with two drives actuating the latter, in a neutral position.

FIG. 5 shows the same diagram, but in this case with the slide piston 13 arranged in it and, again, with drives 15.1 and 15.2 mounted at both lateral ends.

The slide piston 13 has a first annular groove 33 lying exactly centrally and two further annular grooves 34 which lie symmetrically to the center and which cooperate with the annular ducts 21, 28, 25, 23, 19, 24, 26, 29 and 22 and which thus make it possible for the hydraulic oil to flow, as is also outlined.

In the position of the slide piston 13, as shown in FIG. 5, there is the above-mentioned "neutral" position, in which no throughflow is possible from the annular tank-connection duct 20 to the annular A-duct 23 or to the annular B-duct 24. When the slide piston 13 is displaced to the left, then, on the one hand, a connection is made between the annular A-duct 23 and the first annular pump-pressure duct 25 via the left annular groove of the annular grooves 34 and, on the other hand, a connection is made between the annular tank-connection duct 19 and the annular B-duct 24 via the right annular groove of the annular grooves 34. This is one of the working positions. The other working position is obtained by means of a similar displacement of the slide piston 13 to the right.

As already mentioned, the movement of the slide piston 13 takes place by means of the drive 15.1 or 15.2, with the participation of the respective control spring 16. It is important that the two end faces of the slide piston 13 be exposed to the same pressure, as has already been mentioned.

The drive 15.1 is depicted diagrammatically on one side. It has a magnet armature 40 which is movable by a coil, not illustrated. When the coil is excited, the magnet armature 40 acts via a tappet 41 on one end face of the slide piston 13. Between the end face of the slide piston 13 and the drive 15.1 is clamped the control spring 16 which is supported, for example, against a ring 42 on the housing of the drive 15.1. On the opposite side, the second drive 15.2 is shown, which contains the same elements as the drive 15.1. For this exemplary embodiment with magnetic drives 15.1, 15.2, the tank-connection duct connection 20 connects the two annular end-space ducts 21, 22 to the annular tank-connection duct 19 in the way illustrated in FIG. 3. This purpose is served, here again, by the two clearances 32 on the end faces, facing the slide piston 13, of the drives 15.1 and 15.2. In this exemplary embodiment, therefore, the slide piston 13 is pressure-relieved. FIG. 5 shows the slide piston in its neutral position, in which the two drives 15.1, 15.2 are not activated, so that the slide piston 13 is centered in the middle under the action of the two control springs 16. In this position, both the annular tank-connection duct 19, the two annular working-connection ducts, to be precise the annular A-duct 23 and the annular B-duct 24, and the annular pump-pressure ducts 25, 26 are shut off, because none of the annular grooves 33, 34 makes a connection between the annular ducts. No hydraulic oil can therefore flow from and to the differential cylinder 4. The differential cylinder 4 is consequently stationary.

Figure 6:
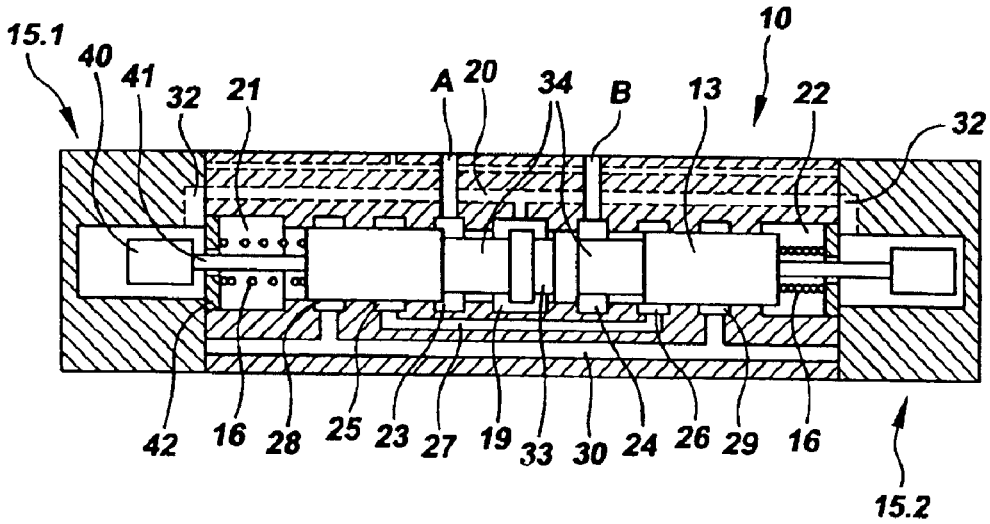
FIG. 6 shows the same diagram in one of the working positions.

FIG. 6 repeats the illustration of FIG. 5, but, here, in a position of the slide piston 13 in which the slide piston 13 is displaced to the right due to the excitation of the first drive 15.1. The right control spring of the control springs 16 is compressed under the action of the drive 15.1. In this position of the slide piston 13, then, there is a connection from the annular A-duct 23 to the annular tank-connection duct 19 via the left annular groove of the two annular grooves 34 and, at the same time, a connection from the annular pump-pressure duct 26 to the annular B-duct 24 via the right annular groove of the two annular grooves 34. The result of this is that, during this activation of the first drive 15.1, hydraulic oil can flow from the pump line P (FIG. 1) via the annular pump-pressure duct 26 to the annular B-duct 24 and from there via the working connection B (FIG. 1) into the second pressure space 3 of the differential cylinder 1 (FIG. 1), while at the same time hydraulic oil can flow out of the first pressure space 2 of the differential cylinder 1 via the working connection A and the annular A-duct 23 to the annular tank-connection duct 19 and from there to the tank connection T. This corresponds to the "lowering" function for the differential cylinder 1.

In a similar way to this, the activation of the second drive 15.2 leads to the "raising" function, in which, as is not shown additionally in a figure, hydraulic oil can flow from the pump connection P via the annular pump-pressure duct 25 to the annular A-duct 23 and further on via the working connection A to the first pressure space 2 of the differential cylinder 1, while at the same time hydraulic oil can flow out of the second pressure space 3 of the differential cylinder 1 via the working connection B and the annular B-duct 24 to the annular tank-connection duct 19 and from there to the tank connection T.

Figure 7:
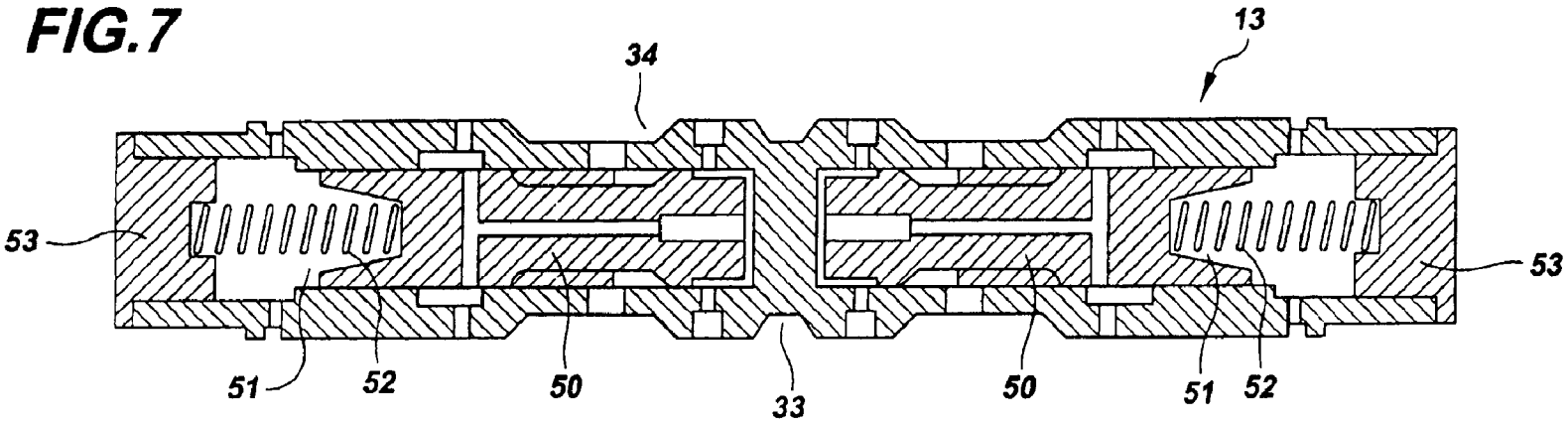
FIG. 7 shows a diagrammatic section through a slide piston with two inner pressure balances.

FIG. 7 shows a diagrammatic sectional drawing of a slide piston 13 with two inner pressure balances 14 (FIG. 1), such as are known in principle from the prior art. Each of these pressure balances 14 has a pressure-balance piston 50 which is axially displaceable within an axial bore 51 of the slide piston 13. The position of the pressure-balance pistons 50 is determined in a known way by the prevailing pressures and a pressure-balance control spring 52 which is supported, on the one hand, on the pressure-balance piston 50 and, on the other hand, on a closing cap 53. These closing caps 53 are screwed on both sides into the slide piston 13 and at the same time form the end faces of the slide piston 13.

Figure 8:
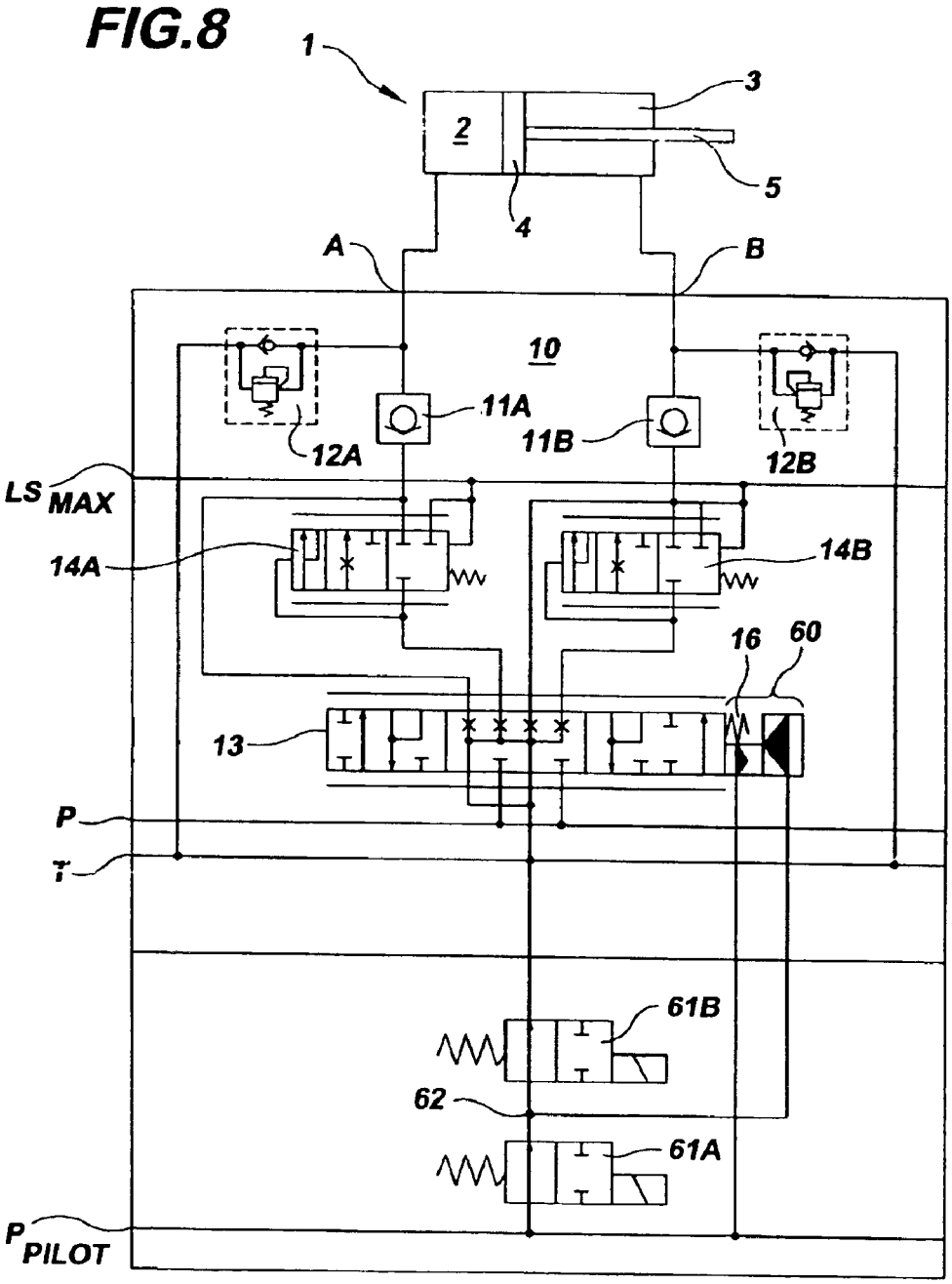
FIG. 8 shows a hydraulic diagram of a further exemplary embodiment.

FIG. 8 shows a hydraulic diagram of a further exemplary embodiment. Here, in contrast to FIG. 1, the drive of the slide piston 13 does not take place by means of two magnetic drives 15.1, 15.2, but by means of a single hydraulic drive 60. Parts with the same reference numerals correspond to the elements shown in FIG. 1.

A first quick-action switching valve 61A and a second quick-action switching valve 61B lie one behind the other between the tank connection T and a pilot-pressure connection $P_{pilot}$. These quick-action switching valves 61A, 61B act as controllable hydraulic resistances, the size of the respective resistance being determined by the clocking ratio of activation, for example by means of pulse-width-modulated signals, that is to say by the ratio "OPEN to SHUT" or "OPEN to (OPEN+SHUT)". The result of this is that, in the connecting line, given the reference numeral 62, between the two quick-action switching valves 61A, 61B, a pressure $p_{St}$ can be controlled which can be set or varied, as desired, within the limits of the pressure prevailing at the tank connection T and at the pilot-pressure connection $P_{pilot}$. This variable pressure $p_{St}$ serves for controlling the slide piston 13, because it is supplied to the drive 60 for the slide piston 13. Moreover, the slide piston 13 is influenced by a control spring 16 which belongs to the drive 60 and which corresponds in functional terms to the control springs 16 of the first exemplary embodiment (FIG. 1). In this advantageous design variant, therefore, the directional valve 10 is a pilot-controllable directional valve.

FIG. 8 again shows, in addition, the pump connection P from which the directional valve 10 is fed with hydraulic oil. By means of this pump connection P, the annular tank-connection duct 19 (FIG. 2) of the directional valve 10 is connected to the control piston 13 in a similar way to the previous exemplary embodiment. Also shown is the load-sensing connection $LS_{max}$ which, as already mentioned, belongs to the prior art in the case of valves of such a type and is therefore not described any further here. The pump connection P, tank connection T, load-sensing connection $LS_{max}$ and pilot-pressure connection $P_{pilot}$ are also present at the right and at the left margin of the diagram in FIG. 8, which again is intended to express the fact that the directional valve 10 is constructed in such a way that a plurality of such directional valves 10 can be lined up to form a block, so that a plurality of consumers can be controlled. In this case, it is advantageously possible that, with the basic form of construction being the same, the individual directional valves 10 have different embodiments according to the general idea of the invention, so that, for example, one is according to FIG. 1 and another is according to FIG. 8. The pressures are again not depicted for the sake of clarity. A pilot pressure $P_{pilot}$ prevails at the pilot-pressure connection $P_{pilot}$, a pressure $p_{LSmax}$ prevails at the load-sensing connection $LS_{max}$ and a control pressure $p_{St}$ prevails in the connecting line 62.

It will be assumed here, for the description of functioning, that the drive 60 is a drive with a differential cylinder, as will also be shown later. On the one hand, the pilot pressure $p_{pilot}$ and, on the other hand, the control pressure $p_{St}$ act on this drive 60. By the control pressure $p_{St}$ being varied as a result of the activation of the quick-action switching valves 61A, 61B, the piston of the drive 60 can be moved and this movement is transmitted to the slide piston 13.

Figure 9:
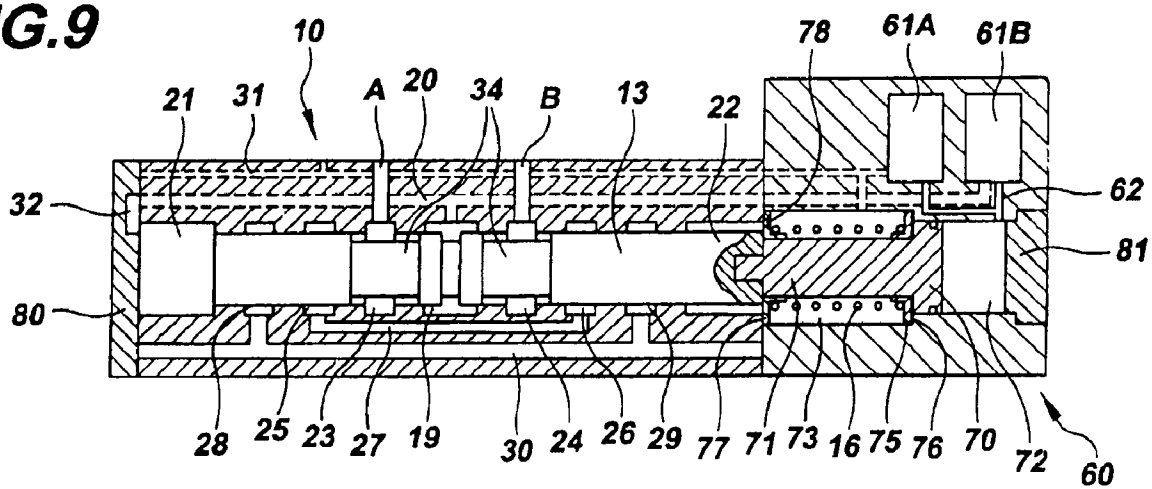
FIG. 9 shows a diagrammatic section through a further exemplary embodiment.

FIG. 9 shows a diagrammatic sectional drawing of the directional valve 10 with the drive 60 mounted on it. The two quick-action switching valves 61A, 61B are installed in the drive 60. The drive 60 consists essentially of a drive piston 70 which is directly connected, for example by means of a screw connection, to the slide piston 13 on one side via a piston rod 71. The rigid connection of the drive piston 70 and the slide piston 13 makes it possible that the drive 60 can move the slide piston 13 out of the middle neutral position in both directions, so that it is possible to manage with a single drive 60. A control-pressure space 72 is adjacent to one side of the drive piston 70, while a pilot-pressure space 73 is arranged, surrounding the piston rod 71, on that side of the drive piston 70 which faces the slide piston 13. The control pressure $p_{St}$ capable of being influenced by the quick-action switching valves 61A, 61B prevails in the control-pressure space 72, while the pilot pressure $P_{pilot}$ prevails in the pilot-pressure space 73. The pilot-pressure line 31, which is present in the directional valve 10 and was already shown in FIGS. 2 to 4 and the connection $P_{pilot}$ of which is also shown in FIG. 8, is thus continued into the housing of the drive 60 and, as can likewise already be seen from FIG. 8, is connected to the quick-action switching valve 61A and, moreover, to the pilot-pressure space 73. It is also possible to see from FIG. 9 the run of the connecting line 62, already shown in FIG. 8, in the housing of the drive 60, said connecting line making a connection between the quick-action switching valves 61A, 61B and the control-pressure space 72. The tank-connection duct connection 20 here connects the annular tank-connection duct 19 to the first annular end-space duct 21. The possibility, provided in the directional valve 10, that the annular tank-connection duct 19 is connectable to the second annular end-space duct 22 by means of the tank-connection duct connection 20 is not utilized here. Since the slide piston 13 is actuated hydraulically in the case of a hydraulic drive 60, in that a hydraulic pressure acts on one end face of the slide piston 13, this connection therefore does not need to be present here. Instead, the tank-connection duct connection 20 leads into the drive 60, specifically to the quick-action switching valve 61B, as can likewise already be seen from FIG. 8, since it is shown there that the quick-action switching valve 61B has a connection to the tank connection T.

The piston rod 71 is surrounded by the control spring 16, already shown in FIG. 8. This control spring 16 is supported, on one side, against the piston 70 or a step 76 via a first ring 75. It is supported, on the other side, on part of the end face of the slide piston 13 via a second ring 77. It is therefore a restrained spring. In this ring 77, there is an orifice 78, by means of which the pilot-pressure space 73 is connected to the second annular end-space duct 22. The movement of the drive piston 70 and therefore of the slide piston 13 is thus influenced by the pressures in the control-pressure space 72 and in the pilot-pressure space 73 and also by the control spring 16. By virtue of the arrangement of the control spring 16, as shown and described, the latter holds the slide piston 13 in the neutral position, shown in FIG. 9, which is equivalent to the neutral position in the first exemplary embodiment (FIG. 5).

On the side located opposite the drive 60, the first annular end-space duct 21 is closed by means of a plate 80. The control-pressure space 72 is closed off by means of an insert 81. The plate 80 may have a similar or identical shape to the insert 81. The clearance 32 already mentioned is arranged in this plate 80 in such a way that said clearance connects the first annular end-space duct 21 to the annular tank-connection duct 20.

It will be assumed here, for the description of functioning, that the drive 60 is an example in which the effective cross section of the piston 70 in the control-pressure space 72 is twice as large as the effective cross section in the pilot-pressure space 73. When the two quick-action switching valves 61A, 61B are activated in such a way that the pressure in the control-pressure space 72, which corresponds to the pressure in the connecting line 62, amounts to half the pressure in the pilot-pressure space 73, which corresponds to the pressure at the pilot-pressure connection $P_{pilot}$, the same force acts on both sides of the piston 70 of the drive 60, so that the piston 70 and consequently the control slide 13 are stationary and are held in the neutral position by the control spring 16.

When the pressure $p_{St}$ in the connecting line 62 and therefore in the control-pressure space 72 is reduced as a result of the corresponding activation of the quick-action switching valves 61A, 61B, the drive 60 moves the slide piston 13 to the right counter to the force of the control spring 16. When the pressure $p_{St}$ in the connecting line 62 and therefore in the control-pressure space 72 is increased, this again being achieved by means of the corresponding activation of the quick-action switching valves 61A, 61B, the drive 60 moves the slide piston 13 to the left.

When the drive 60 is in equilibrium in terms of the pressure forces, the prestressed control spring 16 retains the slide piston 13 between stops in the middle position shown in FIG. 9. The stops are in this case, on the one hand, the first ring 75 which is supported against the piston 70 or the step 76 and, on the other hand, the second ring 77 which is supported on part of the end face of the slide piston 13. The rings 75 and 77 form, together with the prestressed control spring 16, a virtually rigid part which, in the neutral position shown here, can move with a play of only a few tenths of a millimeter between the stops which are provided by the slide piston 13, on the one hand, and by the piston 70 or the step 76, on the other hand. In this position, the slide piston 13 shuts off the connection from the pump connection P to the working connections A and B. This position of the slide piston 13 is the "neutral" position.

In the working positions, therefore, the slide piston 13 can be displaced proportionally by means of the drive 60 and assume any desired positions within the limits of the maximum possible stroke. In this case, owing to the symmetry of the annular ducts 28, 25, 23, 19, 24, 26 and 29, the behavior is identical in terms of its action for the working connections A and B.

It is highly advantageous, as a direct consequence of the invention, that the directional valve 10 can be used, with the same symmetric arrangement of the annular ducts 21, 28, 25, 23, 19, 24, 26, 29 and 22, both for equipping with magnetic drives 15.1 and 15.2 (FIGS. 5 and 6) and for equipping with a single hydraulic drive 60. The only necessary variation in the arrangement of the annular ducts 21, 28, 25, 23, 19, 24, 26, 29 and 22 is that, in the one case, there is a connection from the second annular end-space duct 22 to the annular tank-connection duct 19 by means of the tank-connection duct connection 20, but not in the other case. The manufacture of different variants of directional valves 10 for different applications consequently becomes highly efficient.

Figure 10:
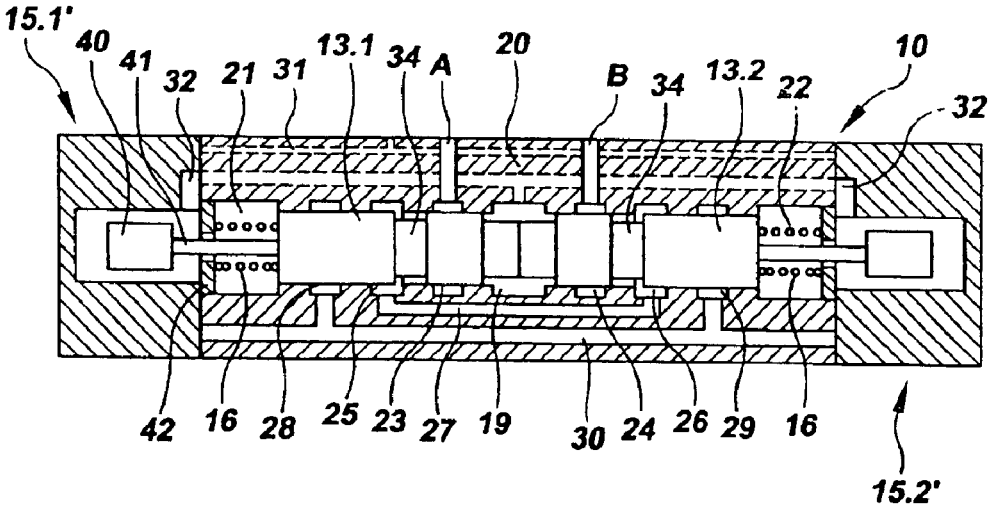
FIG. 10 shows a diagram of a further exemplary embodiment.

FIG. 10 shows a diagram of a further exemplary embodiment. This corresponds to the greatest possible extent to that of FIG. 5, but has the two following essential differences. The slide piston 13 (FIG. 5) is divided, here, into two individual slide pistons, to be precise a first slide piston 13.1 and a second slide piston 13.2. The second difference from FIG. 3 is that the drives 15.1 and 15.2 (FIG. 5) belonging to the slide pistons 13.1, 13.2 do not have a pressing action on the slide pistons 13.1, 13.2, but a pulling action. In view of this significant difference, the drives in FIG. 10 are designated by the reference numerals 15.1' and 15.2'. FIG. 10 shows the neutral position in which neither of the two drives 15.1' and 15.2' is excited.

When the drive 15.1' is excited, its magnet armature 40 pulls the slide piston 13.1 to the left, so that the throughflow of hydraulic oil between the annular tank-connection duct 19 and the annular A-duct 23 is enabled. During this excitation of the drive 15.1', however, the other slide piston 13.2 does not remain in its position corresponding to the neutral position, but is likewise pressed to the left under the action of the control spring 16 assigned to it, so that the two slide pistons 13.1 and 13.2 continue to rest against one another, that is to say continue to act in the same way as a one-part slide piston 13 (FIG. 5). The throughflow of hydraulic oil from the annular pump-pressure duct 26 to the annular B-duct 24 is correspondingly also possible.

The situation is reversed correspondingly when the drive 15.2' is excited. Then, its magnet armature 40 pulls the slide piston 13.2 to the right, so that the throughflow from the annular B-duct 24 to the annular tank-connection duct 19 is possible. During this excitation of the drive 15.2', the other slide piston 13.1 likewise does not remain in its position corresponding to the neutral position, but is likewise pressed to the right under the action of the control spring 60 assigned to it, so that the two slide pistons 13.1 and 13.2 continue to rest against one another, that is to say continue to act in the same way as a one-part slide piston 13 (FIG. 5). The throughflow of hydraulic oil from the annular pump-pressure duct 25 to the annular A-duct 23 is correspondingly also possible. This solution therefore exactly corresponds in functional terms to that which is shown in FIGS. 5 and 6 and described with reference to these figures.

Figure 11:
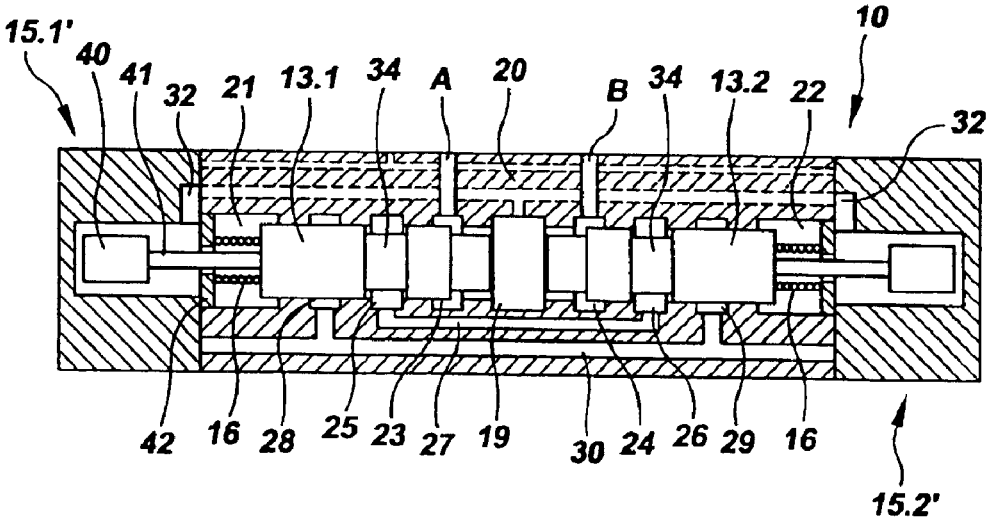
FIG. 11 shows this diagram in the floating position.

By the slide piston 13 (FIG. 5) being divided into the two slide pistons 13.1 and 13.2 and by these being actuated by the two drives 15.1' and 15.2', however, there is in this case the possibility that the two slide pistons 13.1 and 13.2 can be moved independently of one another. When the drives 15.1' and 15.2' are excited simultaneously, the magnet armature 40 of the drive 15.1' pulls the slide piston 13.1 to the left and the magnet armature 40 of the drive 15.2' pulls the slide piston 13.2 to the right, in each case counter to the action of the associated control spring 16. This situation is illustrated in FIG. 11. When the slide pistons 13.1 and 13.2 are in this position during the excitation of the two drives 15.1' and 15.2', it is possible for hydraulic oil to flow from the annular A-duct 23 to the annular tank-connection duct 19 and at the same time also from the annular B-duct 24 to the annular tank-connection duct 19. In this position, the hydraulic oil can flow almost without any resistance from the annular A-duct 23 to the annular B-duct 24, and vice versa. This results in a very simple way in the floating position. This solution is therefore extremely advantageous. Additional means which are necessary in the known prior art are therefore not required here.

For this embodiment with two pulling drives 15.1' and 15.2' and the two slide pistons 13.1 and 13.2, it is mandatory that the two annular end-space ducts 21, 22 be connected to the annular tank-connection duct 19 via the tank-connection duct connection 20, in order to ensure that the same pressure prevails at the end face on the two slide pistons 13.1 and 13.2, in order to operate them with pressure relief.

Figure 12:
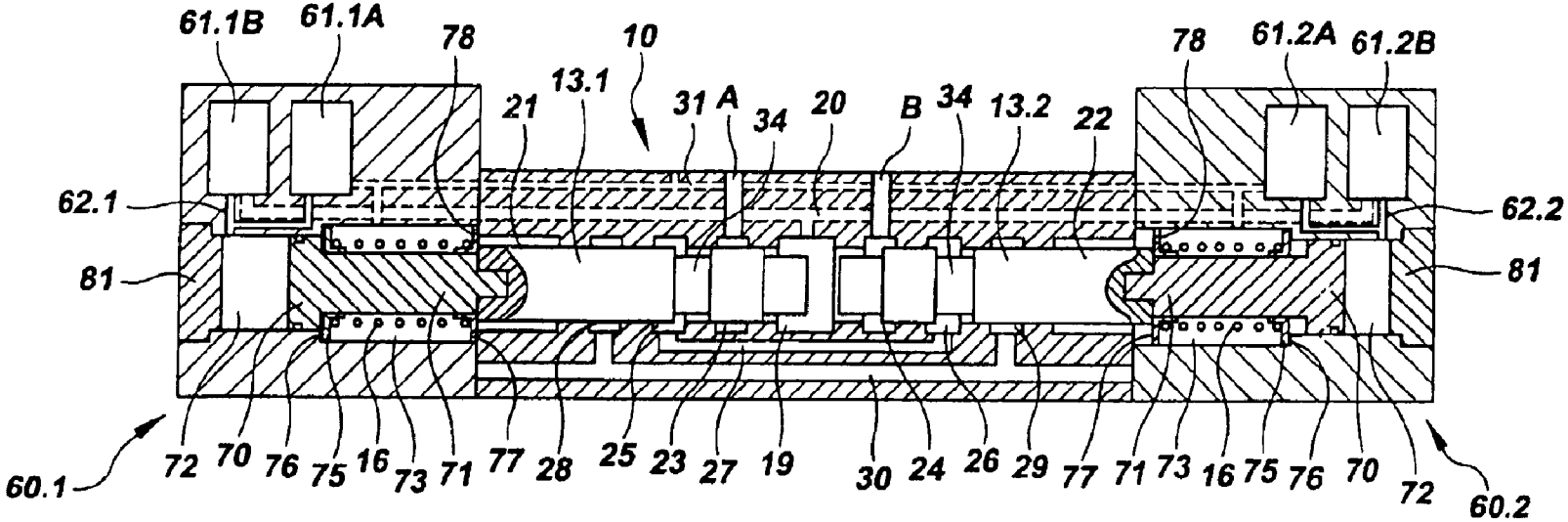
FIG. 12 shows a further exemplary embodiment.

FIG. 12 shows a further exemplary embodiment which corresponds as closely as possible to that of FIGS. 10 and 11, but, instead of the magnetic drives 15.1' and 15.2', has hydraulic drives 60.1 and 60.2 which correspond to the drive 60 already shown in FIG. 9. In the exemplary embodiment of FIG. 12, there is the divided slide piston 13 which is divided into the slide pistons 13.1 and 13.2. This version corresponds in functional terms to that of FIGS. 10 and 11, only with the difference that, in the example of FIG. 12, the movement of the two slide pistons 13.1 and 13.2 takes place as a result of the activation of the quick-action switching valves 61A, 61B, as is described above. In FIG. 12, the slide piston 13.2 illustrated on the right is displaced to the right as a result of the corresponding activation of the quick-action switching valves 61A, 61B, with the result that the control spring 16 contained in the drive 60.2 is compressed, that is to say its spring force codetermines the position of the slide piston 13.2. As already described with regard to the exemplary embodiment of FIG. 11, in this exemplary embodiment it is possible, without additional means being required, to achieve the floating position in a highly advantageous way by means of the corresponding activation of the quick-action switching valves 61A, 61B of the two drives 60.1, 60.2.

Figure 13:
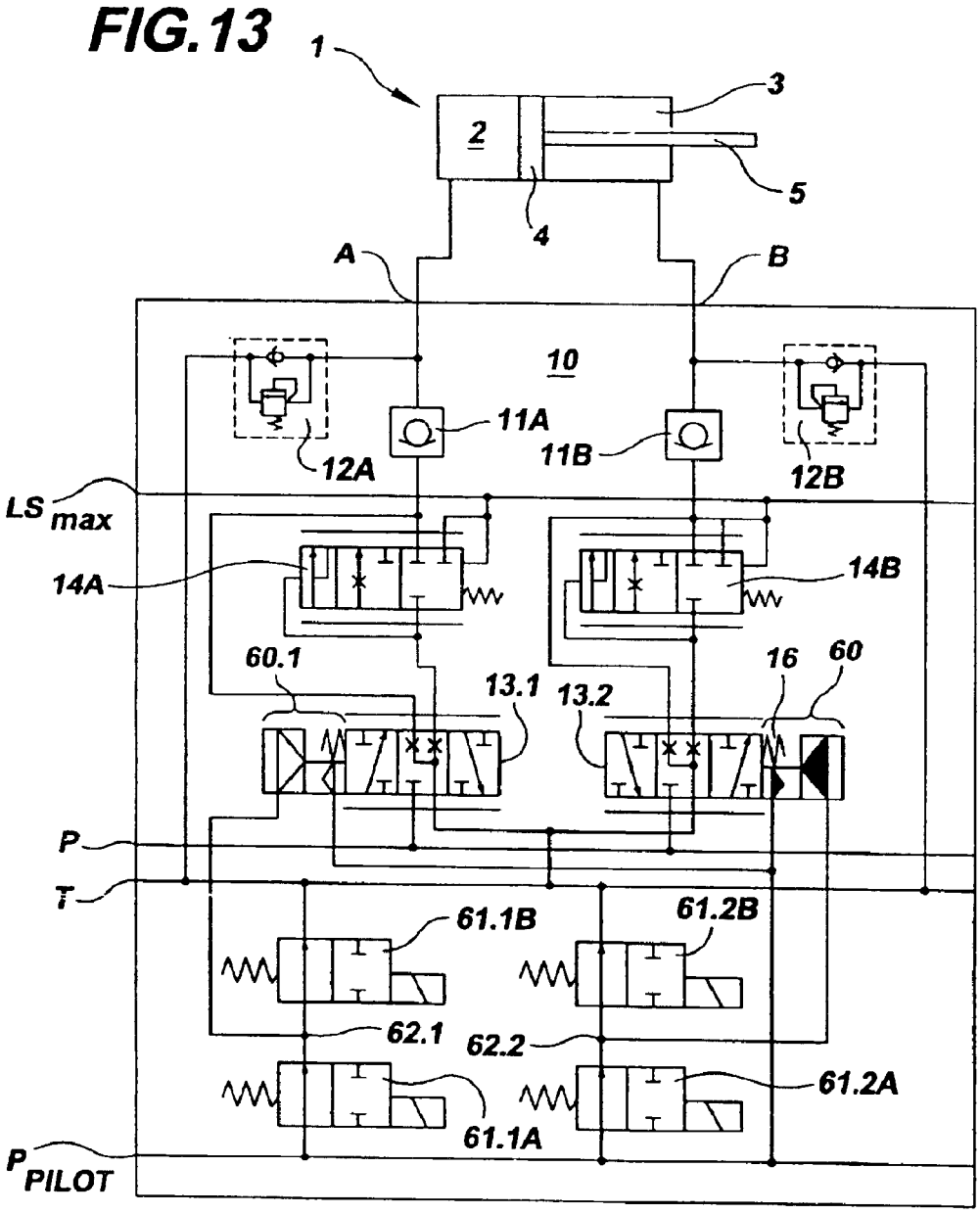
FIG. 13 shows a hydraulic diagram of this.

A hydraulic circuit for this exemplary embodiment is shown in FIG. 13. FIG. 13 corresponds in principle to FIG. 8, but, instead of the single slide piston 13 with the hydraulic drive 60 actuating the latter, has the two separate slide pistons 13.1 and 13.2 with the associated drives 60.1 and 60.2. There is correspondingly also double the number of quick-action switching valves 61, to be precise, on the one hand, the quick-action switching valves 61.1A and 61.1B, which are assigned to the drive 60.1, and the quick-action switching valves 61.2A and 61.2B, which belong to the drive 60.2.

Instead of the single connecting line 62 of FIG. 8, in which the control pressure $p_{St}$ for controlling the drive 60 prevails, two connecting lines 62.1 and 62.2 are shown in FIG. 13. A control pressure $p_{St1}$, which has the effect of controlling the drive 60.1, prevails in the connecting line 62.1. In a similar way to this, a control pressure $p_{St2}$, which has the effect of controlling the drive 60.2, prevails in the connecting line 62.2.

Figure 14:
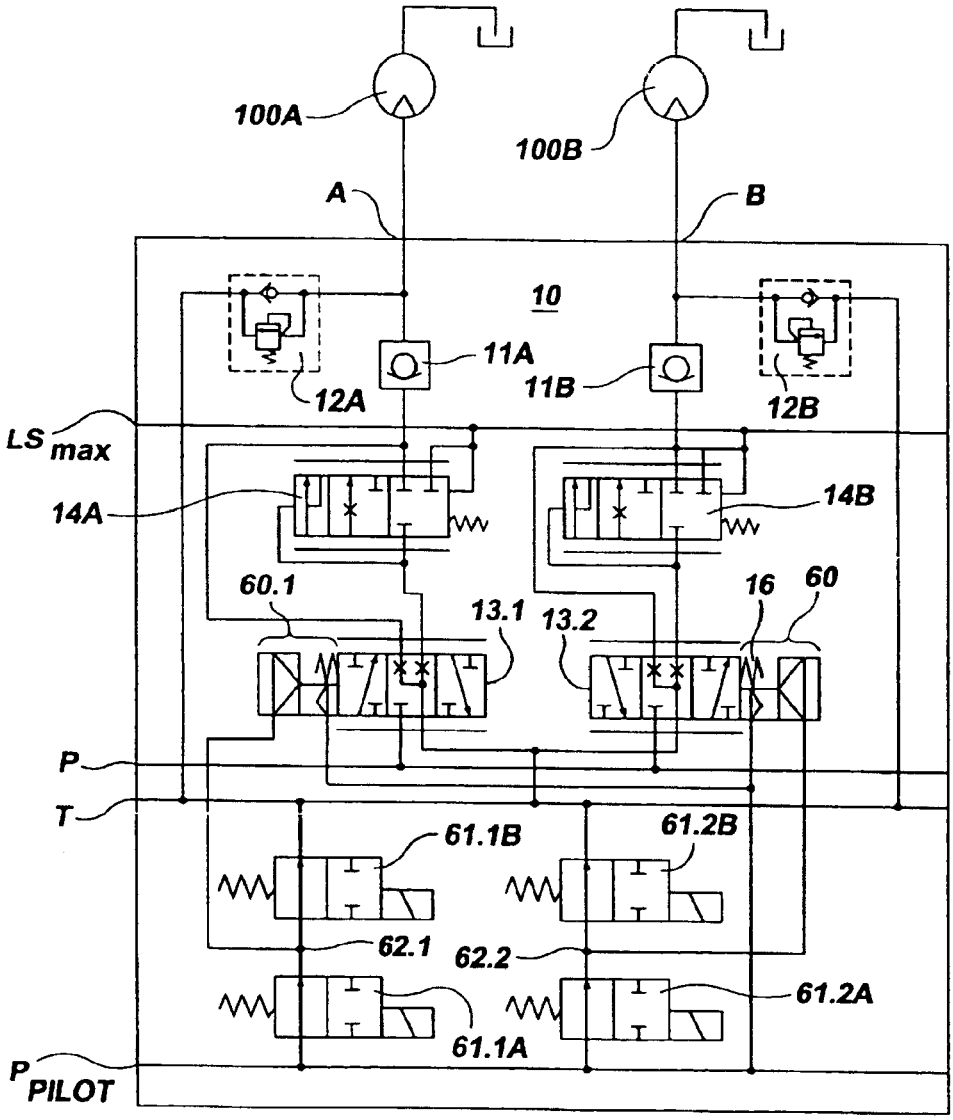
FIG. 14 shows a further hydraulic diagram of this.

A further hydraulic diagram is shown in FIG. 14. This largely corresponds to FIG. 13, but, instead of the differential cylinder 1, there are two hydraulic consumers independent of one another, to be precise a first consumer 100A and a second consumer 100B. The first consumer 100A is connected to the first working connection A of the directional valve 10, and the second consumer 100B is connected to the second working connection B. Since, as mentioned above, in the case of a divided slide piston 13, the two slide pistons 13.1 and 13.2 can be controlled independently of one another, it is therefore possible, by means of one directional valve 10 in the form of construction shown in FIG. 12, to operate two hydraulic consumers 100A, 100B independently of one another.

The possibilities afforded by the directional valve 10 according to the invention become obvious. Moreover, automatic control systems are possible with the aid of pressure sensors and electrical control members. Instead of quick-action switching valves, the directional valve 10 according to the invention may also use other means, for example electrically controllable pressure-reducing valves.

By virtue of the symmetry and arrangement according to the invention of the annular ducts 21, 28, 25, 23, 19, 24, 26, 29 and 22 and of the equivalent hydraulic conditions thereby achieved for the two working connections A and B, it is possible, in addition to the exemplary embodiments shown above, also to implement further variants for different applications. Thus, for example, it is possible to dispense with the pressure balances 14. Also, as shown above, it is possible to use two hydraulic drives 60 instead of two magnetically actuable drives 15, in which case it is possible to provide such a variant with the slide piston 13 divided into two slide pistons 13.1, 13.2, in order in a simple way to implement the function of the floating position even in the case of a directional valve 10 controlled by pilot pressure. It thus becomes possible, by means of the invention, to implement a large number of variants in the manner of a modular construction system without directional valves 10 constructed in a fundamentally different way being necessary.

What is claimed is:

1. A directional valve for controlling the pressure and flow of hydraulic oil to and from a consumer, said valve comprising:

first and second working connections for connecting to said consumer;

a slide bore having an axis of symmetry;

a slide piston movable in said slide bore;

a drive for actuating said piston; and a plurality of annular ducts surrounding said slide bore and communicating with said slide bore, said annular ducts comprising:

an annular tank connection duct on said axis of symmetry;

first and second annular working ducts arranged symmetrically to said axis of symmetry and connected to respective first and second working connections;

first and second annular pump pressure ducts arranged symmetrically to said axis of symmetry, outside of said working ducts, and connected to each other by a pump pressure duct connection;

first and second annular load sensing ducts arranged symmetrically to said axis of symmetry, outside of said pump pressure ducts, and connected to each other by a load-sensing connecting line; and first and second annular end space ducts arranged symmetrically to said axis of symmetry, outside of said annular load sensing ducts, and connectable to other said annular ducts.

2. A directional valve as in claim 1 wherein said drive comprises first and second electrically activatable magnetic drives which act on opposite sides of said slide piston counter to control springs, said directional valve further comprising a tank connection duct connection connecting said annular tank connection duct to said annular end space ducts.

3. A directional valve as in claim 1 wherein said first and second annular end space ducts are connected to said load sensing connecting line, and wherein said drive comprises first and second electrically activatable magnetic drives which act on opposite sides of said slide piston counter to control springs.

4. A directional valve as in claim 1 wherein said first and second annular end space ducts are connected to said first and second annular pump pressure ducts by said pump pressure duct connection, and wherein said drive comprises first and second electrically activatable magnetic drives which act on opposite sides of said slide piston counter to control springs.

5. A directional valve as in claim 1 wherein said drive comprises first and second electrically activatable magnetic drives which act on opposite sides of said slide piston counter to control springs, said magnetic drives having end faces with clearances which provide connections to said first and second annular end space ducts.

6. A directional valve as in claim 5 wherein said slide piston comprises first and second slide piston parts connected to respective first and second electrically activatable magnetic drives, each said magnetic drive having a pulling action on the respective piston part.

7. A directional valve as in claim 1 further comprising an annular tank connection duct connection connecting said annular tank connection duct to said first annular end space duct, and a pilot pressure line connected to said second annular end space duct, wherein said drive is a hydraulically acting drive with a differential piston.

8. A directional valve as in claim 1 wherein said slide piston comprises first and second piston parts, said drive comprising first and second hydraulic drive pistons which are rigidly connected to respective said piston parts.

* * * * *